US008876323B2

(12) United States Patent
Khanampornpan

(10) Patent No.: US 8,876,323 B2
(45) Date of Patent: Nov. 4, 2014

(54) FLUORESCENT LAMP HOLDER ASSEMBLY

(76) Inventor: Viroj Khanampornpan, Bangkok (TH)

( * ) Notice: Subject to any disclaimer, the term of this patent is extended or adjusted under 35 U.S.C. 154(b) by 0 days.

(21) Appl. No.: 13/822,717

(22) PCT Filed: Sep. 17, 2010

(86) PCT No.: PCT/TH2010/000034

§ 371 (c)(1),
(2), (4) Date: Mar. 13, 2013

(87) PCT Pub. No.: WO2012/036643

PCT Pub. Date: Mar. 22, 2012

(65) Prior Publication Data

US 2013/0182427 A1 Jul. 18, 2013

(51) Int. Cl.

| | |
|---|---|
| ***F21V 21/00*** | (2006.01) |
| ***H01R 33/00*** | (2006.01) |
| ***H01R 13/627*** | (2006.01) |
| ***F21V 19/00*** | (2006.01) |
| *H01R 13/639* | (2006.01) |

(52) U.S. Cl.

CPC ..... *F21V 19/0005* (2013.01); *H01R 13/6275* (2013.01); *H01R 13/6395* (2013.01); *H01R 13/6273* (2013.01)

USPC ..... 362/217.17; 362/652; 362/655; 439/226; 439/232; 439/236

(58) Field of Classification Search

CPC ..... H01R 13/6273; H01R 13/8275; F21V 19/005; H02R 13/6395

USPC ..... 362/217.17, 217.08, 376, 647, 651, 362/652, 655; 439/226, 232, 236, 240

See application file for complete search history.

(56) References Cited

U.S. PATENT DOCUMENTS

| | | | | |
|---|---|---|---|---|
| 2,231,851 | A | 2/1941 | Fryer | |
| 2,350,341 | A * | 6/1944 | De Reamer | 439/231 |

(Continued)

FOREIGN PATENT DOCUMENTS

| | | |
|---|---|---|
| BE | 438595 | 11/1947 |
| CN | 201187745 | 1/2009 |

(Continued)

OTHER PUBLICATIONS

International Search Report and Written Opinion dated May 17, 2011 for International App. PCT/TH2010/000034.

(Continued)

*Primary Examiner* — John A Ward
(74) *Attorney, Agent, or Firm* — Kim Winston LLP

(57) ABSTRACT

Fluorescent lamp holder assembly (10) comprising a lamp holder (15) and a socket (20). The holder (15) houses one pair of electrical terminals, and includes one pair of openings (30) located at a position corresponding to the position of the electrical terminals. The lamp holder (15) includes one pair of parallel spaced-apart legs (35) with one end connected to the terminal and the free end protruding from the body of the holder (15). The socket (20) has one pair of spaced-apart electrical terminals defining insertion inlets (45). The holder (15) can be coupled to the socket (20) by inserting the legs (35) into the corresponding terminals of the socket (20). The holder assembly (10) further comprises releasable, resiliently biased locking means (60) movable between an opening position, in which holder (15) and socket (20) can be unplugged and a locking position, in which holder (15) and socket (20) are held together.

18 Claims, 5 Drawing Sheets

(56) References Cited

U.S. PATENT DOCUMENTS

| | | | | |
|---|---|---|---|---|
| 2,401,408 | A * | 6/1946 | Bixby | 439/232 |
| 2,449,736 | A | 9/1948 | Bogen et al. | |
| 2,483,165 | A * | 9/1949 | Young | 439/238 |
| 2,507,898 | A | 5/1950 | Gaynor et al. | |
| 2,511,155 | A | 6/1950 | Gaynor et al. | |
| 3,344,390 | A | 9/1967 | Dell et al. | |
| 4,280,169 | A * | 7/1981 | Allen | 362/217.08 |
| 5,006,970 | A * | 4/1991 | Mackiewicz | 362/382 |
| 7,291,029 | B2 * | 11/2007 | Hale et al. | 439/236 |
| 8,206,167 | B2 * | 6/2012 | Reuter et al. | 439/236 |
| 2007/0001573 | A1 | 1/2007 | Nelson et al. | |

FOREIGN PATENT DOCUMENTS

| | | |
|---|---|---|
| DE | 3818517 | 12/1989 |
| EP | 0768697 | 4/1997 |
| GB | 630143 | 10/1949 |
| JP | 3291803 | 12/1991 |
| JP | H04108889 | 9/1992 |

OTHER PUBLICATIONS

Written Opinion dated Aug. 23, 2012 for International App. PCT/TH2010/000034.

* cited by examiner

FLUORESCENT LAMP HOLDER ASSEMBLY

CROSS-REFERENCE TO RELATED APPLICATION

This application is a U.S. national phase application under 35 U.S.C. §371 of International Application No. PCT/TH2010/000034 filed Sep. 17, 2010, which is hereby incorporated by reference in its entirety.

BACKGROUND OF THE INVENTION

The present invention relates to electrical engineering, in particular to a lamp holder and more particularly to a tubular fluorescent lamp holder according to the preamble of claim 1. The two most common fluorescent lamp holder assemblies for by-pin fluorescent lamps are the so-called "twisted type" and "spring type".

In the "twisted type" lamp holder assembly shown in FIG. 1, during the installation of the lamp, the pins at both ends of the fluorescent lamp must first be introduced into radial grooves in the lamp holder adapted to receive these pins and then the lamp must be twisted about 90 degrees around its longitudinal axis to complete the installation.

In the "spring type" lamp holder assembly shown in FIG. 2, during installation of a lamp, the pins on one end of the lamp are inserted first into a pin dock of the lamp holder provided with a spring. Then, the spring must be pressed inwards, and afterwards the other end follows the same way. The exertion of the springs on each end of the lamp holds the lamp in place.

In both types of fluorescent lamp holder assemblies, the installation or replacement of the lamp requires a certain skill and it becomes especially difficult when these operations must be done at a certain height, for example at the top of a ladder.

In order to overcome these problems, lamp holder assemblies comprising a socket and a connectable lamp holder have been suggested. In detail, a socket is fixed to the lighting fixture, one at each end, and electrically connected to an electrical source. The socket comprises two electrical terminals defining insertion inlets for the corresponding legs of the holder. On the other hand, the holder comprises two legs electrically connectable to the pins of the fluorescent lamp and adapted for connection in the insertion inlets of the socket. During the installation, first the pins of each fluorescent lamp ends are inserted into the corresponding holder terminals. Afterwards, this subassembly is connected to the fixture by inserting the legs of each holder into the insertion inlets of its corresponding socket in a direction normal to the fluorescent lamp's axis. However, this solution has the problem, that the holder can loosen from the socket and thus the fluorescent lamp can fall down.

In order to overcome this problem, document U.S. Pat. No. 2,449,736 discloses a lamp holder assembly of the type described above, in which the holder is provided with protruding spring type latching legs which can be deflected towards each other by means of finger grips pivoted to the body of the holder. The free end of these parallel legs also has outwardly projecting prongs. When the holder is plugged into the socket, converging slopes provided within the housing. of the socket deflect the prongs, and thus the legs, toward each other. Once the prongs have surpassed these slopes, the legs snap back to their original position and establish an electrical contact with the corresponding electrical terminals in the socket. Furthermore, the prongs prevent the holder from being pulled out of the socket. This solution has the drawback that less pressure can be exerted between the terminals of the socket and the holder and therefore a less reliable electrical contact can be achieved. Furthermore, if a user tries to replace the lamp by pulling the socket without disengaging the outwardly projecting prongs pressing on the finger grips, the legs and thus the electrical contact between the terminals can seriously be damaged.

Document GB 630,143 discloses securing means between the socket and the holder. The holder is secured to the socket by passing a pin through an aperture in the holder, into the socket until the grooves provided at the end of the pin are received and held in spring members provided in the socket. When the pin is rotated 90 degrees around its axis, the grooves are disengaged from the spring means and thus, the holder can be removed from the socket. This system is quite complicated and since the pin is rather small, it is not easy to handle.

Document U.S. Pat. No. 2,231,851 also discloses securing means between the socket and the holder of a fluorescent lamp holder assembly. In this case, the blade or flat type terminals of the holder are provided with protuberances adapted to snap into corresponding recesses in the socket terminals. This solution unnecessarily increases the plugging and unplugging force needed to assemble and disassemble the holder and can hinder installing or replacing the fluorescent lamp.

Document U.S. Pat. No. 2,511,155 discloses securing means between the holder and the socket via the fluorescent lamp. To this end, the lighting fixture is provided with spring clips located on the underside of the lighting fixture and between the lamp holders. The spring clips are arranged to resiliently hold the metallic sleeves supporting the connection pins at each end of the fluorescent lamp. One of the drawbacks of this solution is that when plugging or unplugging the holder, an additional force is exerted on the pins of the fluorescent lamp which can eventually lead to pin damage if both holders are misaligned during the plugging or unplugging process.

Document JP 3291803A discloses a lamp socket providing a contact piece which can be removably engaged with a lamp socket mounting base and is to be connected to a joint piece at the time of mounting it onto the mounting base. In assembling the lighting fixture, a fitting part 15 of a lamp socket 12 is fitted into a fitting recess 8 of a lamp socket mounting base 4, a protrusion 16 is fitted into a recessed stage 9 while a contact piece 17 of the protrusion 16 is brought into contact with the contact piece 10 of the recessed stage 9 to have them electrically connected to each other. An elastic hook piece 18 provided on the rear of the protrusion 16 is engaged with an engaging locking hole 11 formed on the recessed stage 9 at this time, wherein the lamp socket 12 is engaged and held by the lamp socket mounting base 4. When the lamp socket 12 is to be removed from the mounting base 14, by pushing the elastic hook piece 18 provided on the rear of the protrusion 16, engagement between the elastic hook piece 18 and the engaging locking hole 11 is released so that the lamp socket 12 can be removed from the mounting base 4.

Therefore, it is an object of the present invention to provide an alternative fluorescent lamp holder assembly wherein installation or replacement of a fluorescent lamp can be done conveniently and easily and preventing the user from having to exert unnecessary plugging or unplugging forces.

SUMMARY OF THE INVENTION

This objective is achieved by means of a fluorescent lamp holder assembly indicated at the beginning, further comprising the features of the characterising portion of claim 1.

Thanks to the lamp holder assembly of the invention the retaining mechanical function of the fluorescent lamp assembled with its lamp holders is split from the electrical supply function. In other words, the locking means assumes the function of holding the fluorescent lamp in place, thus preventing it from falling due to its own weight when the lighting fixture is hung from the ceiling or on a wall. Therefore, the retaining force exerted by the socket terminals on the legs of the lamp holder must only be dimensioned such as to guarantee a good electrical contact and not to support the own weights of the holder and fluorescent lamp. Also when the lighting fixture is hung on a wall, the locking means support part of the own weight of the fluorescent lamp and the legs of the holder are also preserved more appropriately. Therefore, in general, the plugging or unplugging of the fluorescent lamp with lamp holders requires reduced plugging and unplugging forces and eases the installation or replacement of the fluorescent lamp.

It is desirable that the locking means are as simple as possible. Therefore, preferably the locking means comprises a snap fit locking mechanism.

In the invention it is convenient that the snap fit locking mechanism can be operated in a simple way without the need of additional tools for the installation or replacement procedures. Therefore, preferably the locking means comprises at least an operable cantilever arm protruding from said body in the direction of said legs and pivotally arranged on a wall of said body at a pivoting zone between the opening and the locking positions, the free end of the arm being provided with a side projection arranged to engage at a corresponding shoulder of the socket.

In a preferred embodiment of the invention, the locking means further comprises a lever arm projecting from said pivoting zone opposite to said cantilever arm to operate said cantilever arm between said opening and said locking positions. This makes it possible to obtain increased retaining forces without the user exerting considerable force in order to release the locking means.

Preferably said locking means further comprises a tongue projecting from said lever arm towards said body of the holder to resiliently bias said locking means in its locking position. This simplifies design and assembly and offers a robuster construction because no additional parts such as springs are needed to guarantee the biasing of the locking means.

Preferably said locking means includes grip enhancing surface textures or patterns on its external surface to prevent fingers slipping during the unplugging process of the holder and the fluorescent lamp.

Preferably the assembly comprises auxiliary lighting means activable when the fluorescent lamp is turned off or burnt out, to facilitate the replacement of the fluorescent lamp once it is burnt out.

In order to achieve a versatile socket adapted to work with different types of holders and fluorescent lamps, preferably said insertion inlets are configured to receive both flat and rounded cross section legs. Also preferably said holder comprises at least two pairs of openings adapted to receive different fluorescent lamp sizes. This also allows production and logistic costs to be reduced, because fewer types of sockets need to be produced.

According to a further aspect of the invention, the holder is double sided, said holder comprising a first pair of openings arranged on said wall and a second pair of openings arranged on a back wall opposed to said wall. This simplifies the connection of more than one fluorescent lamp in series, since for the connection of two adjacent lamps one single holder is required.

Also preferably said wall of said lamp holder comprises an elongated dock, in that said first pair of openings is arranged on said elongated dock and in that said elongated dock is capable of receiving the end of a bulb. This allows the connection of standard fluorescent lamps of different lengths only by turning the lamp holder on 180°.

The lamp holder assembly of the invention is also intended to be mounted in lighting fixtures intended for places where little electrical installation is available. Therefore, preferably the lamp holder assembly of the invention further comprises an on-off switch. This avoids the need of installing separate switches to operate the lighting fixture. This is specially suitable, for example on constructions sites where no final electrical installation is yet available.

Preferably said holder and said socket comprise mating guiding elements on their corresponding facing walls in order to serve as a guide and achieve a better coupling.

BRIEF DESCRIPTION OF THE DRAWINGS

Other advantages and characteristics of the invention will be appreciated from the following description, in which, as a non-limiting example, some preferable embodiments of the invention are described, with reference to the accompanying drawings, in which.

DETAILED DESCRIPTION OF THE INVENTION

Figure 1:
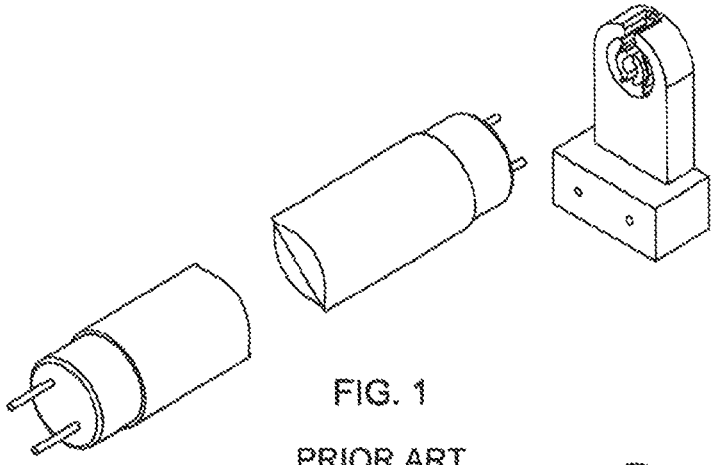
FIG. 1 PRIOR ART
FIG. 1 shows a perspective view of a "twisted type" lamp holder assembly.
Figure 2:
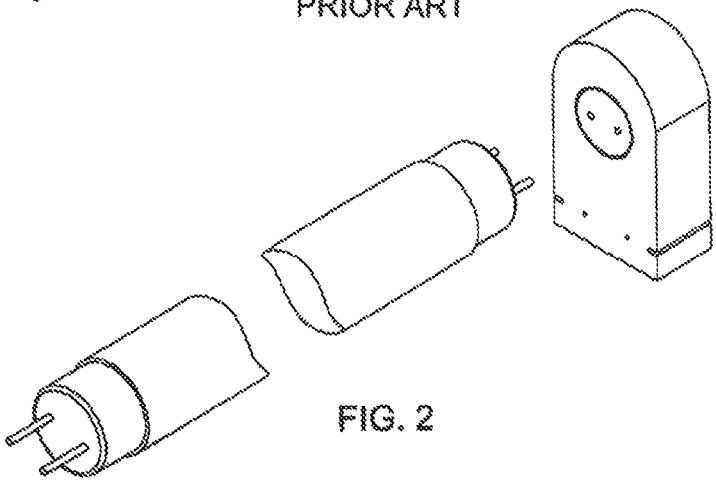
FIG. 2 PRIOR ART
FIG. 2 shows a perspective view of a "spring type" lamp holder assembly.
Figure 3:
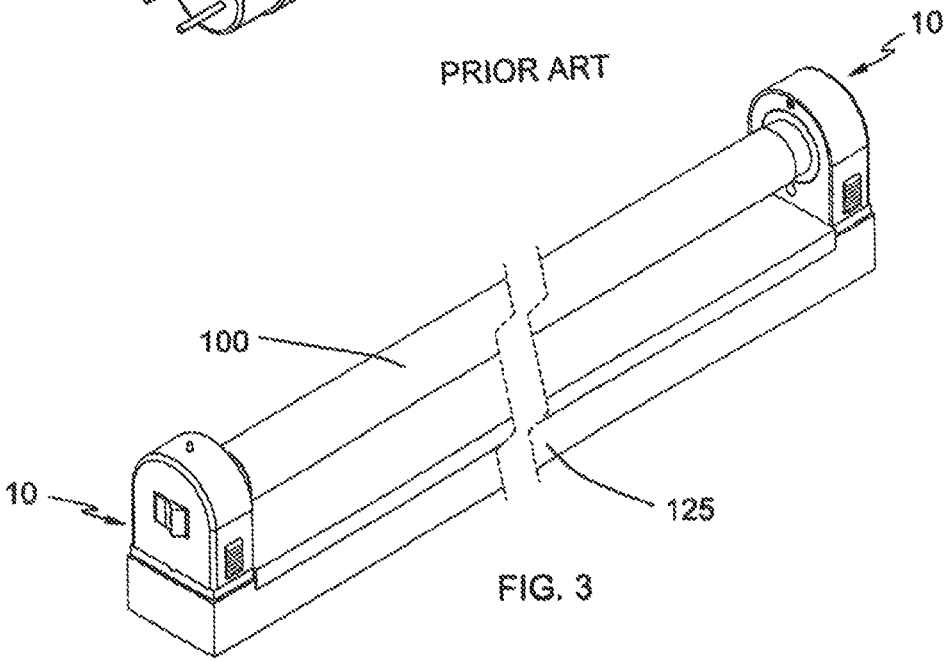
FIG. 3 shows a perspective view of a lighting fixture comprising fluorescent lamp holder assemblies according to the invention.
Figure 4:
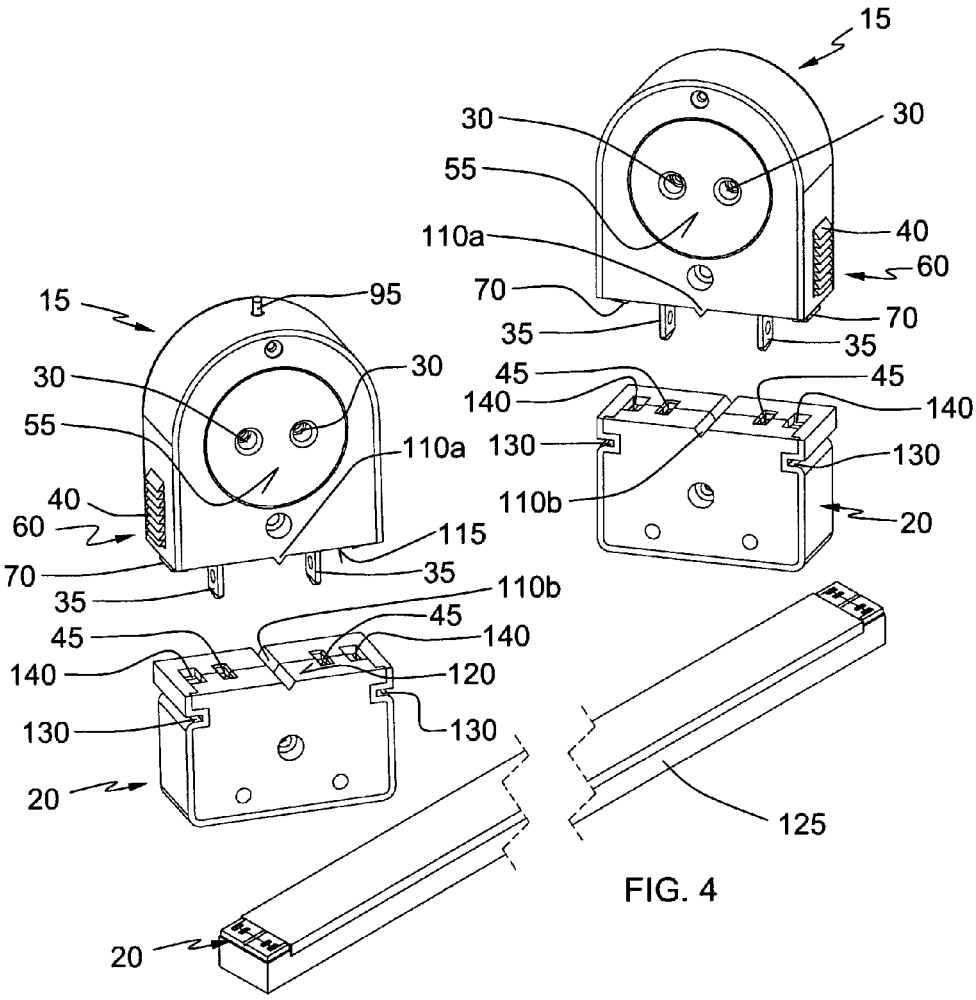
FIG. 4 shows a front perspective view of a lamp holder assembly.
Figure 5:
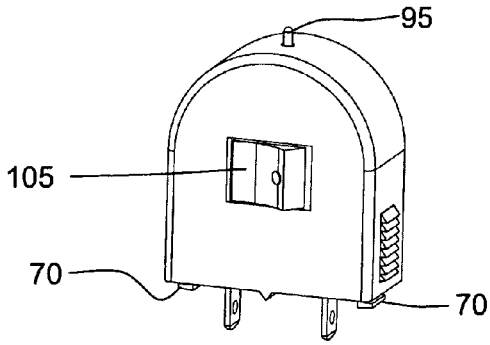
FIG. 5 shows a back perspective view of the lamp holder on the left hand side of FIG. 4.

FIGS. 3 to 5 show a first embodiment of the lamp holder assembly according to the invention.

As can be seen, the fluorescent lamp holder assembly 10 comprises generally a lamp holder 15 and socket 20.

The lamp holder 15 has a body which houses a pair of electrical terminals and a pair of openings 30 leading to the electrical terminals on the wall 55 of the lamp holder 15 on which the fluorescent lamp 100 is to be plugged in. Further, the lamp holder 15 has a pair of parallel spaced-apart protruding legs 35 of which one end is connected to the terminal and the free end protrudes from the body in the direction of the socket 20.

On the other hand, the socket 20, which is fixed to the lighting fixture 125 via lateral recesses 130 guided in corresponding rails in the lighting fixture 125, also has a pair of spaced-apart electrical terminals. As it is apparent to the skilled person, the lateral recesses 130 are one of the several ways of attaching the socket 20 to the lighting fixture 125 and therefore they are not essential to the invention. Each of these terminals defines insertion inlets 45 in which the legs 35 of the holder 15 can be inserted, thus defining electrical connection means.

Both holder 15 and socket 20 can be produced by any suitable production technique known by the skilled person. However it is preferred that the housings of these two elements are produced by injection moulding in a suitable material such as acrylonitrile butadiene styrene (ABS), polyvinyl chloride (PVC), polycarbonate (PC) or polyethylene (PE), because these materials can be recycled. On the other hand, the legs and electrical terminals, and legs 35 can be produced by stamping or turning any suitable conducting metal such as copper or the like.

Figure 6A:
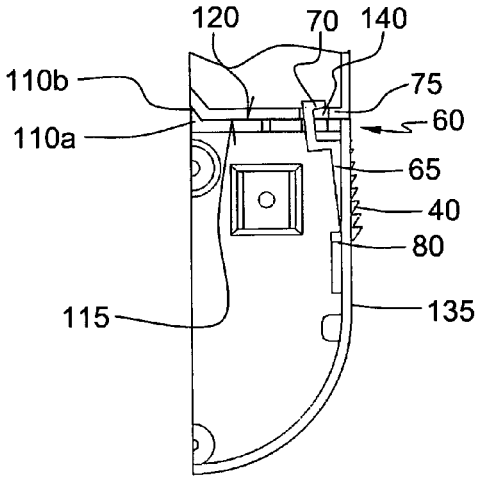
FIG. 6A shows a schematic front section view of the locking mechanism of the lamp holder assembly in an opening position.
Figure 6B:
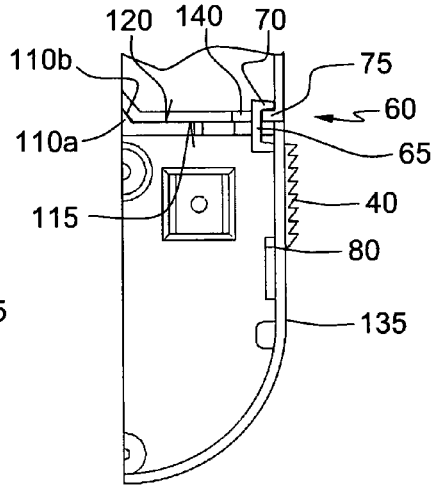
FIG. 6B shows a schematic front section view of the locking mechanism of the lamp holder assembly in a locking position.

In the figures, and specially in FIGS. 6A and 6B it can be appreciated that the holder assembly 10 further comprises releasable, resiliently biased locking means 60. In this particular embodiment, the locking means 60 comprise a snap fit locking mechanism. The locking means 60 is movable between an opening position (see FIG. 6A), in which the holder 15 and the socket 20 can be unplugged and a locking position (see FIG. 6B), in which the holder 15 and the socket 20 are held together via the locking means 60. Also, as it is apparent to the skilled person from the figures, the locking means 60 is separated from the electrical connection means with the advantages already explained in previous paragraphs.

Regarding the structure of the locking means 60, FIGS. 4 and 6A and 6B show in greater detail that two operable cantilever arms 65 are provided on the side walls 135 of the holder 15. These arms 65 protrude from the body of the holder 15 in the same direction as the legs 35 and are pivotally arranged on the side walls 135 of the body at a pivoting zone 80. Therefore, the biasing function in this case is provided by the own elasticity of the arms 65, which provides a very simple and economic design. Furthermore, the free end of the arms 65 has a side projection 70 in the form of a hook. In turn, the socket 20 is provided with two passageways 140 adapted to let the free end of the arms 65 pass through during the plugging and unplugging process. The projection 70 is then arranged to engage at a corresponding shoulder 75 in the interior of the socket 20. FIG. 6A schematically shows the opening position of the arms 65 corresponding to the moment when the user is plugging or unplugging the holder 15, while FIG. 6B shows the locking position in which the lamp holder assembly 10 is in service. Further, in order to facilitate the movement between these two positions, the locking means 10 include grip enhancing surface textures or patterns 40 on the external surface of the cantilever arm 65. It is also worth mentioning that the operable arms 65 could also be arranged on the socket 20 projecting towards the holder 15, while, in this case, the holder 15 would then comprise the passageways 140 and the corresponding shoulders 75 would be adapted for the engagement of the projections 70.

FIG. 4 also shows that the holder 15 and the socket 20 have mating guiding elements 110*a*, 110*b* on their corresponding facing walls 115, 120. In this case the guiding element 110*a* of the holder 15 is a wedge shaped protrusion on the wall 115 insertable in a mating wedge shaped groove provided on the wall 120 of the socket 20. However, other shapes as a semi-circular protrusion and groove could also satisfactorily fulfill the same centering and holding function.

In the FIGS. 4 and 5 it can further be seen that this embodiment of the lamp holder assembly 10 comprises auxiliary lighting means 95. This lighting means 95 solve the problem of facilitating the replacement of a burnt out fluorescent lamp 100, because it turns on when the lamp is turned off.

Finally, FIG. 5 also shows that the lamp holder assembly 10 can be provided with an on-off switch 105 which avoids the need for a preinstalled switch in the room where the lighting fixture retrofitted with the lamp holder assembly 10 of the invention, is to be installed.

Figure 7:
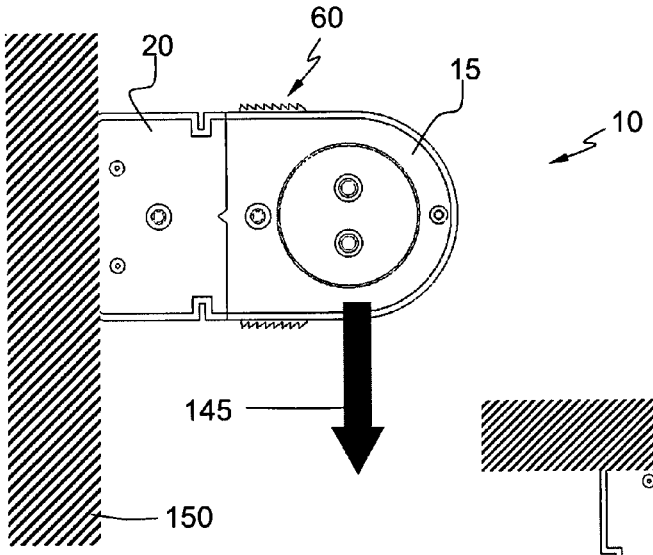
FIG. 7 shows a schematic front view of a lamp holder assembly according to the invention hung on a vertical wall.
Figure 8:
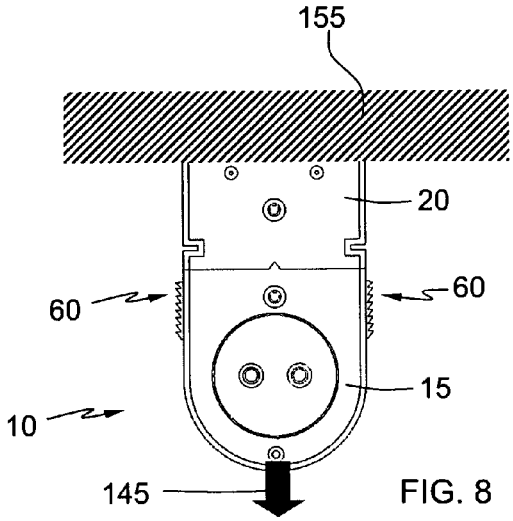
FIG. 8 shows a schematic front view of a lamp holder assembly according to the invention hung from a ceiling.

Now on the basis of FIGS. 7 and 8, it will be easier to understand the advantages of the invention. The lamp holder assembly 10 of FIG. 7 is hanging on a vertical wall 150. The arrow shows the effect of the own weight 145. As it will be apparent to the skilled person, the own weight 145 of holders 15 and fluorescent lamp 100 pulls the subassembly downwards. Thus, thanks to the solution proposed by the invention, this own weight 145 is mainly supported by locking means 60, and more precisely by the upper locking means 60 in FIG. 7, which due to the own weight 145 are under tensile stress. In this way, the terminals of the lamp holder assembly 10 are protected and must not to exert the mechanical holding function. Since the terminals of holder 15 and socket 20 only need to be dimensioned to guarantee a good electrical contact, the pressure of the socket 20 terminals on the holder 15 legs 35 can be reduced, and thus the plugging and unplugging of the holder can be made much easier.

FIG. 8 shows the case, in which the lighting fixture 125 is hanging from a ceiling 155. In this case the locking means 60 at the sides of the holder 15 support the own weight 145. In fact during tests carried out during the development of the invention the embodiment depicted in FIGS. 3 to 6B held a load of 12 kg, thus guaranteeing a specially strong mechanical performance from which the electrical part of the lighting fixture benefits, as explained above.

Figure 9:
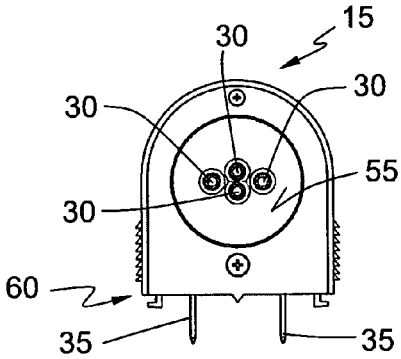
FIG. 9 shows a front view of a double sided lamp holder comprising two pairs of openings for the pins of the fluorescent lamp on each side.
Figure 10:
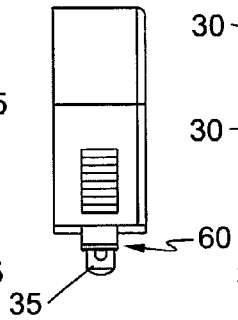
FIG. 10 shows a side view of a lamp holder of FIG. 9.
Figure 11:
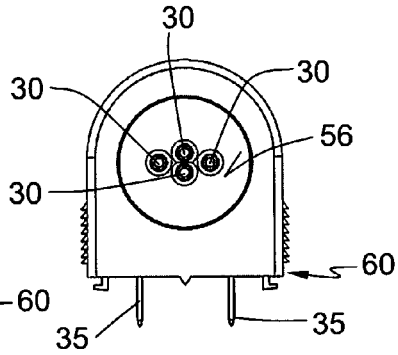
FIG. 11 shows a back view of the lamp holder of FIG. 9.

FIGS. 9 to 11 show another embodiment of the invention with most of the features explained above and which therefore do not need to be explained in further detail. However, in this case, the holder 15 of this embodiment is double sided and comprises two pairs of openings 30 adapted to receive different fluorescent lamp 100 sizes on each side. In this particular embodiment, the same holder 15 could accommodate both T5 and T8 fluorescent lamp. Furthermore, the holder 15 being double sided comprises two pairs of openings 30 on both the front wall 55, as well as on the back wall 56. By means of this solution, installations of a plurality of series aligned fluorescent lamps 100 can be more compact, because two adjacent fluorescent lamps 100 require one single lamp holder assembly 10.

Figure 12:
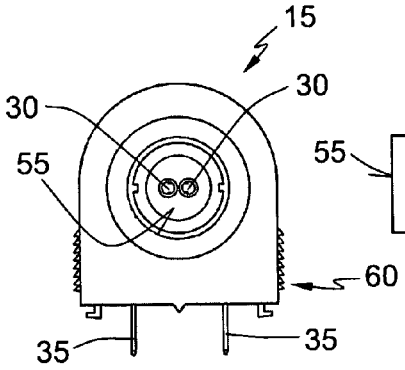
FIG. 12 shows a front view of a double sided lamp holder with an elongated dock comprising a pair of openings for the pins of the fluorescent lamp on each side.
Figure 13:
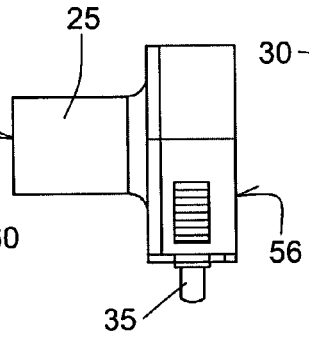
FIG. 13 shows a side view of a lamp holder of FIG. 12.
Figure 14:
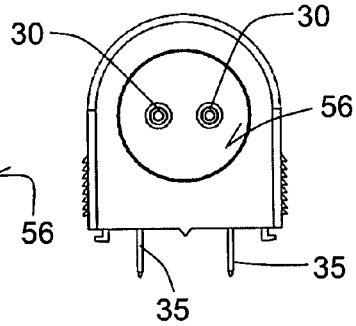
FIG. 14 shows a back view of the lamp holder of FIG. 12.

Further, FIGS. 12 to 14 show another embodiment of a double sided lamp holder 15. In this case, differently to the embodiment of the previous paragraph, the holder 15 comprises a single pair of openings 30 on both front and back walls 55, 56. Furthermore the wall 55 of the lamp holder 15 comprises an elongated dock 25 on which the first pair of openings 30 is arranged for receiving a fluorescent lamp 100.

In the market the most common fluorescent lamps are T8 and T5, T8 being larger in diameter and also longer. T8 and T5 fluorescent lamps cannot be used interchangeably on the same lighting fixture. However, with the holder 15 shown, the same lighting fixture 125 can be used for two different fluorescent lengths, without the need of using an adapter. To this end the holder needs only to be turned on 180° in order to adapt the holder to the length needed.

Figure 15:
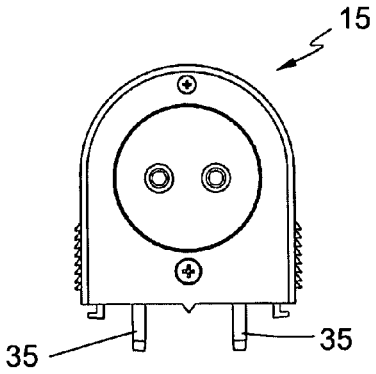
FIG. 15 shows a front view of a lamp holder with round connection legs or pins.
Figure 16:
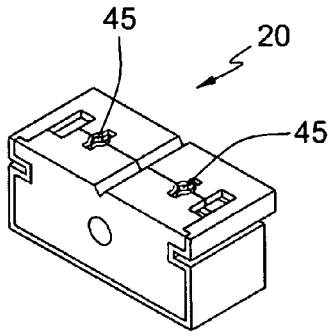
FIG. 16 shows a perspective view of a socket adapted to receive lamp holders with flat and round connection legs.

FIGS. 15 and 16 show a third embodiment of the lamp holder assembly 10 of the invention. Again, almost all the features have already been explained before. However, in this case the lamp holder 15 is provided with rounded cross section legs 35. This solution provides a robuster construction of the holder 15 and thus increases the durability of the lamp holder assembly 10. On the other hand, FIG. 16 shows that the socket 20 of this embodiment comprises insertion inlets 45 adapted to receive both flat and rounded cross section holder 15 legs 35. In this way production and logistic costs can be noticeably reduced, because one single socket 20 serves for different holder types.

Figure 17:
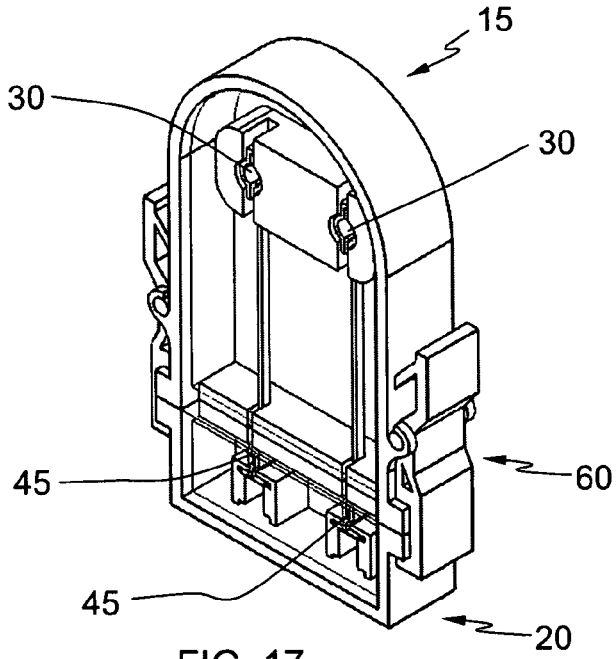
FIG. 17 shows a perspective section view of another embodiment of the lamp holder assembly.
Figure 18:
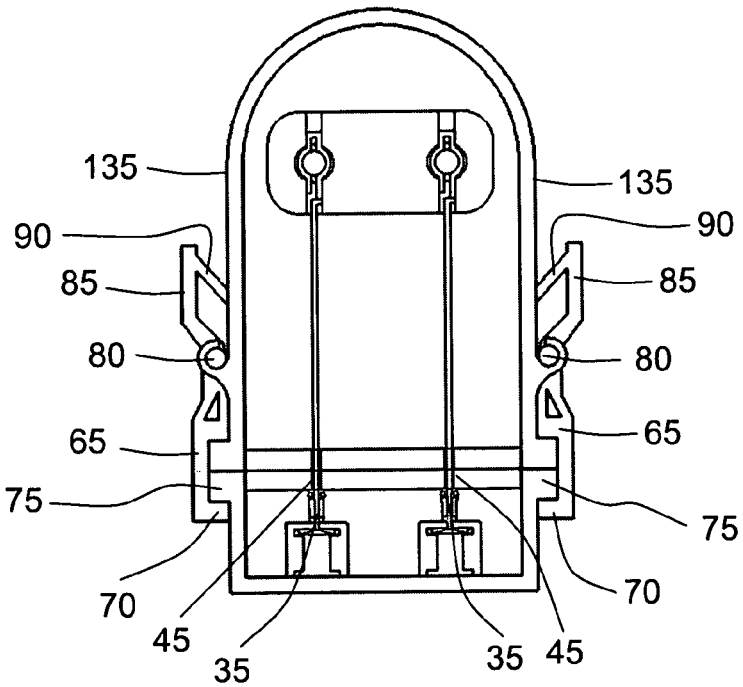
FIG. 18 shows a front section view of the lamp holder assembly of FIG. 17.

Finally, FIGS. 17 and 18 show a further embodiment of the lamp holder assembly 10 of the invention. In this case, further to the general features already explained in FIGS. 4 to 6B, the lamp holder assembly 10 has the two operable cantilever arms 65 pivotally arranged on the side walls 135 of the holder 15 with a side projection 70 in the form of a hook. Furthermore, the locking function is exerted from the outside of the housings of the holder 15 and socket 20. Additionally, the locking means 60 also comprises a lever arm 85 projecting from said pivoting zone 80 opposite to the cantilever arm 65 to operate said cantilever arm 65 between the opening and the locking positions. Also a tongue 90 projecting from the lever arm 85 towards the body of the holder 15 resiliently bias said locking means 60 in its locking position. One of the advantages of providing the lever arm 85 is that less effort is needed by the user when pivoting the cantilever arms 65 between opening and locking positions. Furthermore, there is now no need for additional elastic elements such as springs or the like in order to assure that the lamp holder assembly 10 remains in the locking position during service, because the tongue 90 assumes this function.

I claim:

1. Fluorescent lamp holder assembly (10) comprising:

[a] a lamp holder (15) having a body which houses at least one pair of electrical terminals, the said body includes at least one pair of openings (30) on at least one wall (55), the said openings (30) located at a position corresponding to the position of the electrical terminals such that each opening (30) leads to one respective terminal; said lamp holder (15) includes at least one pair of parallel spaced-apart legs (35) of which one end of each leg (35) is connected to the terminal and the free end of each leg (35) protrudes from the said body,

[b] a socket (20) having at least one pair of spaced-apart electrical terminals, each defining an insertion inlet (45); such that the lamp holder (15) can be coupled to the socket (20) by inserting a corresponding leg (35) of the lamp holder (15) into the corresponding terminal of the socket (20) thus defining electrical connection means, the holder assembly (10) further comprising

[c] releasable, resiliently biased locking means (60) movable between an opening position, in which said holder (15) and said socket (20) can be unplugged and a locking position, in which said holder (15) and said socket (20) are held together, and

[d] said locking means (60) being separated from said electrical connection means, characterised in that

[e] the holder (15) is double sided, said holder (15) comprising a first pair of openings (30) arranged on said wall (55) and a second pair of openings (30) arranged on a back wall (56) opposed to said wall (55), and said first pair of openings (30) seen in a front view are identically oriented as the second pair of openings (3) seen in a front view.

2. Fluorescent lamp holder assembly (1) according to claim 1, characterised in that the said locking means (60) comprises a snap fit locking mechanism.

3. Fluorescent lamp holder assembly (1) according to claim 2, characterised in that said locking means (60) comprises at least an operable cantilever arm (65) protruding from said body in the direction of said legs (35) and pivotally arranged on a wall of said body at a pivoting zone (80) between said opening and said locking positions, the free end of said arm (65) being provided with a side projection (70) arranged to engage at a corresponding shoulder (75) of the socket (20).

4. Fluorescent lamp holder assembly (1) according to claim 1, characterised in that said locking means (60) comprises at least an operable cantilever arm (65) protruding from said body in the direction of said legs (35) and pivotally arranged on a wall of said body at a pivoting zone (80) between said opening and said locking positions, the free end of said arm (65) being provided with a side projection (70) arranged to engage at a corresponding shoulder (75) of the socket (20).

5. Fluorescent lamp holder assembly (10) according to claim 4, characterised in that said locking means (60) further comprises a lever arm (85) projecting from said pivoting zone (80) opposite to said cantilever arm (65) to operate said cantilever arm (65) between said opening and said locking positions.

6. Fluorescent lamp holder assembly (10) according to claim 5, characterised in that said locking means (60) further comprises a tongue (90) projecting from said lever arm (85) towards said body of the holder (15) to resiliently bias said locking means (60) in its locking position.

7. Fluorescent lamp holder assembly (10) according to claim 6, characterised in that said locking means (10) includes grip enhancing surface textures or patterns (40) on its external surface.

8. Fluorescent lamp holder assembly (10) according to claim 1, characterised in that said locking means (10) includes grip enhancing surface textures or patterns (40) on its external surface.

9. Fluorescent lamp holder assembly (10) according to claim 8, characterised in that it comprises auxiliary lighting means (95) activable when the fluorescent lamp is turned off or burnt out.

10. Fluorescent lamp holder assembly (10) according to claim 1, characterised in that it comprises auxiliary lighting means (95) activable when the fluorescent lamp is turned off or burnt out.

11. Fluorescent lamp holder assembly (1) according to claim 10, characterised in that said insertion inlets (45) are configured to receive both flat and rounded cross section legs (35).

12. Fluorescent lamp holder assembly (1) according to claim 1, characterised in that said insertion inlets (45) are configured to receive both flat and rounded cross section legs (35).

13. Fluorescent lamp holder assembly (1) according to claim 12, characterised in that said holder (15) comprises at least two pairs of openings (30) adapted to receive different fluorescent lamp (100) sizes.

14. Fluorescent lamp holder assembly (1) according to claim 1, characterised in that said holder (15) comprises at least two pairs of openings (30) adapted to receive different fluorescent lamp (100) sizes.

15. Fluorescent lamp holder assembly (1) according to claim 1, characterised in that said wall (55) of said lamp holder (15) comprises an elongated dock (25) , in that said first pair of openings (30) is arranged on said elongated dock (25) and in that said elongated dock (25) is capable of receiving the end of a bulb.

16. Fluorescent lamp holder assembly (1) according to claim 15, characterised in that it further comprises an on-off switch (105).

17. Fluorescent lamp holder assembly (1) according to claim 1, characterised in that it further comprises an on-off switch (105).

18. Fluorescent lamp holder assembly (1) according to claim 17, characterised in that said holder (15) and said socket (20) comprise mating guiding elements (110*a*, 110*b*) on their corresponding facing walls (115, 120).

* * * * *

UNITED STATES PATENT AND TRADEMARK OFFICE

CERTIFICATE OF CORRECTION

PATENT NO. : 8,876,323 B2
APPLICATION NO. : 13/822717
DATED : November 4, 2014
INVENTOR(S) : Viroj Khanampornpan It is certified that error appears in the above-identified patent and that said Letters Patent is hereby corrected as shown below:

Delete the title page and substitute the attached title page therefor.

In the claims

In claim 1, column 8, line 6, delete "(3)" and insert -- (30) --.

In claim 2, column 8, line 8, delete "(1)" and insert -- (10) --.

In claim 3, column 8, line 11, delete "(1)" and insert -- (10) --.

In claim 4, column 8, line 19, delete "(1)" and insert -- (10) --.

In claim 11, column 8, line 56, delete "(1)" and insert -- (10) --.

In claim 12, column 8, line 60, delete "(1)" and insert -- (10) --.

In claim 13, column 8, line 64, delete "(1)" and insert -- (10) --.

In claim 14, column 9, line 1, delete "(1)" and insert -- (10) --.

In claim 15, column 9, line 5, delete "(1)" and insert -- (10) --.

In claim 16, column 9, line 11, delete "(1)" and insert -- (10) --.

In claim 17, column 9, line 14, delete "(1)" and insert -- (10) --.

In claim 18, column 9, line 17, delete "(1)" and insert -- (10) --.

Signed and Sealed this
Twenty-eighth Day of July, 2015

Michelle K. Lee

Michelle K. Lee
*Director of the United States Patent and Trademark Office*

Add claim 19 to the listing of claims. Claim 19 corresponds to original claim 13 which was omitted from the printing of the patent. Insert as Claim 19, column 9, line 21

-- 19. Fluorescent lamp holder assembly (1) according to any of the claims 1 or 12, characterised in that said holder (15) and said socket (20) comprise mating guiding elements (110a, 110b) on their corresponding facing walls (115, 120). --

(12) United States Patent
Khanampornpan

(10) Patent No.: US 8,876,323 B2
(45) Date of Patent: Nov. 4, 2014

(54) FLUORESCENT LAMP HOLDER ASSEMBLY

(76) Inventor: Viroj Khanampornpan, Bangkok (TH)

( * ) Notice: Subject to any disclaimer, the term of this patent is extended or adjusted under 35 U.S.C. 154(b) by 0 days.

(21) Appl. No.: 13/822,717

(22) PCT Filed: Sep. 17, 2010

(86) PCT No.: PCT/TH2010/000034
§ 371 (c)(1),
(2), (4) Date: Mar. 13, 2013

(87) PCT Pub. No.: WO2012/036643
PCT Pub. Date: Mar. 22, 2012

(65) Prior Publication Data
US 2013/0182427 A1 Jul. 18, 2013

(51) Int. Cl.

| | |
|---|---|
| ***F21V 21/00*** | (2006.01) |
| ***H01R 33/00*** | (2006.01) |
| ***H01R 13/627*** | (2006.01) |
| ***F21V 19/00*** | (2006.01) |
| ***H01R 13/639*** | (2006.01) |

(52) U.S. Cl.
CPC ..... *F21V 19/0005* (2013.01); *H01R 13/6275* (2013.01); *H01R 13/6395* (2013.01); *H01R 13/6273* (2013.01)
USPC ..... 362/217.17; 362/652; 362/655; 439/226; 439/232; 439/236

(58) Field of Classification Search
CPC ..... H01R 13/6273; H01R 13/8275; F21V 19/005; H02R 13/6395
USPC ..... 362/217.17, 217.08, 376, 647, 651, 362/652, 655; 439/226, 232, 236, 240
See application file for complete search history.

(56) References Cited

U.S. PATENT DOCUMENTS

| | | | | |
|---|---|---|---|---|
| 2,231,851 | A | 2/1941 | Fryer | |
| 2,350,341 | A * | 6/1944 | De Reamer | 439/231 |

(Continued)

FOREIGN PATENT DOCUMENTS

| | | |
|---|---|---|
| BE | 438595 | 11/1947 |
| CN | 201187745 | 1/2009 |

(Continued)

OTHER PUBLICATIONS

International Search Report and Written Opinion dated May 17, 2011 for International App. PCT/TH2010/000034.

(Continued)

*Primary Examiner* — John A Ward
(74) *Attorney, Agent, or Firm* — Kim Winston LLP

(57) ABSTRACT

Fluorescent lamp holder assembly (10) comprising a lamp holder (15) and a socket (20). The holder (15) houses one pair of electrical terminals, and includes one pair of openings (30) located at a position corresponding to the position of the electrical terminals. The lamp holder (15) includes one pair of parallel spaced-apart legs (35) with one end connected to the terminal and the free end protruding from the body of the holder (15). The socket (20) has one pair of spaced-apart electrical terminals defining insertion inlets (45). The holder (15) can be coupled to the socket (20) by inserting the legs (35) into the corresponding terminals of the socket (20). The holder assembly (10) further comprises releasable, resiliently biased locking means (60) movable between an opening position, in which holder (15) and socket (20) can be unplugged and a locking position, in which holder (15) and socket (20) are held together.

19 Claims, 5 Drawing Sheets

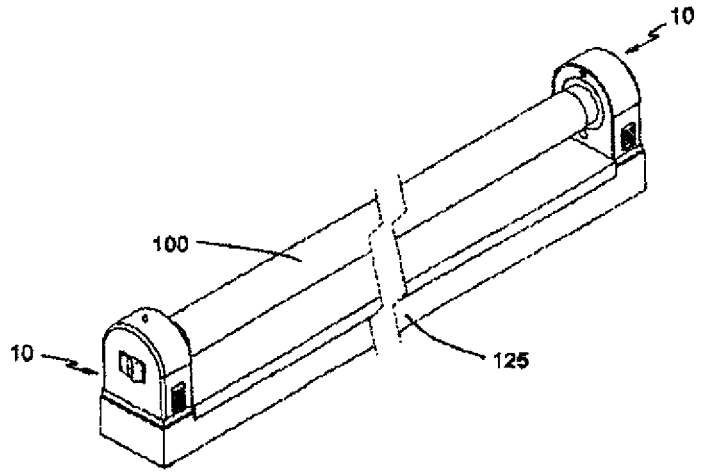

UNITED STATES PATENT AND TRADEMARK OFFICE

CERTIFICATE OF CORRECTION

PATENT NO. : 8,876,323 B2
APPLICATION NO. : 13/822717
DATED : November 4, 2014
INVENTOR(S) : Viroj Khanampornpan It is certified that error appears in the above-identified patent and that said Letters Patent is hereby corrected as shown below:

Delete the title page and substitute the attached title page therefor.

In the claims

In claim 1, column 8, line 6, delete "(3)" and insert -- (30) --.

In claim 2, column 8, line 8, delete "(1)" and insert -- (10) --.

In claim 3, column 8, line 11, delete "(1)" and insert -- (10) --.

In claim 4, column 8, line 19, delete "(1)" and insert -- (10) --.

In claim 11, column 8, line 56, delete "(1)" and insert -- (10) --.

In claim 12, column 8, line 60, delete "(1)" and insert -- (10) --.

In claim 13, column 8, line 64, delete "(1)" and insert -- (10) --.

In claim 14, column 9, line 1, delete "(1)" and insert -- (10) --.

In claim 15, column 9, line 5, delete "(1)" and insert -- (10) --.

In claim 16, column 9, line 11, delete "(1)" and insert -- (10) --.

In claim 17, column 9, line 14, delete "(1)" and insert -- (10) --.

In claim 18, column 9, line 17, delete "(1)" and insert -- (10) --.

This certificate supersedes the Certificate of Correction issued July 28, 2015.

Signed and Sealed this
First Day of March, 2016

Michelle K. Lee

Michelle K. Lee
*Director of the United States Patent and Trademark Office*

Insert claim 19 in column 9, line 21:

-- Claim 19. Fluorescent lamp holder assembly (1) according to claim 1, characterized in that said holder (15) and said socket (20) comprise mating guiding elements (110a, 110b) on their corresponding facing walls (115, 120). --.

(12) United States Patent
Khanampornpan

(10) Patent No.: US 8,876,323 B2
(45) Date of Patent: Nov. 4, 2014

(54) FLUORESCENT LAMP HOLDER ASSEMBLY

(76) Inventor: Viroj Khanampornpan, Bangkok (TH)

( * ) Notice: Subject to any disclaimer, the term of this patent is extended or adjusted under 35 U.S.C. 154(b) by 0 days.

(21) Appl. No.: 13/822,717

(22) PCT Filed: Sep. 17, 2010

(86) PCT No.: PCT/TH2010/000034
§ 371 (c)(1),
(2), (4) Date: Mar. 13, 2013

(87) PCT Pub. No.: WO2012/036643
PCT Pub. Date: Mar. 22, 2012

(65) Prior Publication Data
US 2013/0182427 A1 Jul. 18, 2013

(51) Int. Cl.

| | |
|---|---|
| ***F21V 21/00*** | (2006.01) |
| ***H01R 33/00*** | (2006.01) |
| ***H01R 13/627*** | (2006.01) |
| ***F21V 19/00*** | (2006.01) |
| ***H01R 13/639*** | (2006.01) |

(52) U.S. Cl.
CPC ..... *F21V 19/0005* (2013.01); *H01R 13/6275* (2013.01); *H01R 13/6395* (2013.01); *H01R 13/6273* (2013.01)
USPC ..... 362/217.17; 362/652; 362/655; 439/226; 439/232; 439/236

(58) Field of Classification Search
CPC ..... H01R 13/6273; H01R 13/8275; F21V 19/005; H02R 13/6395
USPC ..... 362/217.17, 217.08, 376, 647, 651, 362/652, 655; 439/226, 232, 236, 240
See application file for complete search history.

(56) References Cited

U.S. PATENT DOCUMENTS 2,231,851 A 2/1941 Fryer
2,350,341 A * 6/1944 De Reamer ..... 439/231
(Continued)

FOREIGN PATENT DOCUMENTS

BE 438595 11/1947
CN 201187745 1/2009
(Continued)

OTHER PUBLICATIONS

International Search Report and Written Opinion dated May 17, 2011 for International App. PCT/TH2010/000034.
(Continued)

*Primary Examiner* — John A Ward
(74) *Attorney, Agent, or Firm* — Kim Winston LLP

(57) ABSTRACT

Fluorescent lamp holder assembly (10) comprising a lamp holder (15) and a socket (20). The holder (15) houses one pair of electrical terminals, and includes one pair of openings (30) located at a position corresponding to the position of the electrical terminals. The lamp holder (15) includes one pair of parallel spaced-apart legs (35) with one end connected to the terminal and the free end protruding from the body of the holder (15). The socket (20) has one pair of spaced-apart electrical terminals defining insertion inlets (45). The holder (15) can be coupled to the socket (20) by inserting the legs (35) into the corresponding terminals of the socket (20). The holder assembly (10) further comprises releasable, resiliently biased locking means (60) movable between an opening position, in which holder (15) and socket (20) can be unplugged and a locking position, in which holder (15) and socket (20) are held together.

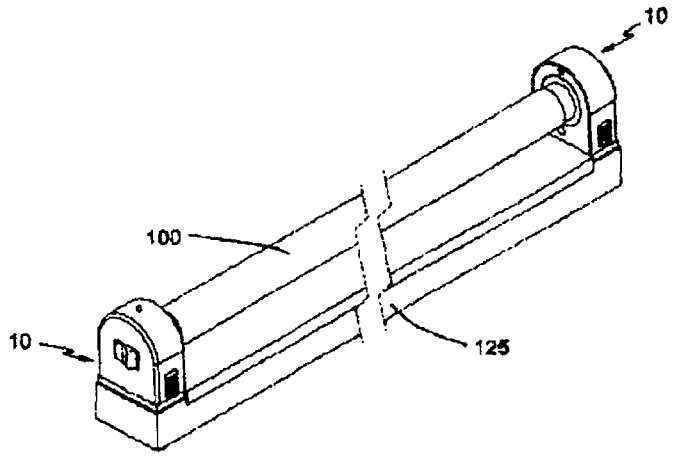

19 Claims, 5 Drawing Sheets